US006336419B1

(12) United States Patent
Breivik

(10) Patent No.: US 6,336,419 B1
(45) Date of Patent: Jan. 8, 2002

(54) FLOATING STRUCTURE

(75) Inventor: Kåre Breivik, Ugelid (NO)

(73) Assignee: Navion AS, Stavanger (NO)

( * ) Notice: Subject to any disclaimer, the term of this patent is extended or adjusted under 35 U.S.C. 154(b) by 0 days.

(21) Appl. No.: 09/701,864

(22) PCT Filed: Jun. 4, 1999

(86) PCT No.: PCT/NO99/00182

§ 371 Date: Feb. 2, 2001

§ 102(e) Date: Feb. 2, 2001

(87) PCT Pub. No.: WO99/62763

PCT Pub. Date: Dec. 9, 1999

(30) Foreign Application Priority Data

Jun. 5, 1998 (NO) ..... 982585

(51) Int. Cl.[7] ..... B63B 21/56
(52) U.S. Cl. ..... 114/248; 114/258
(58) Field of Search ..... 114/247, 258, 114/242

(56) References Cited

U.S. PATENT DOCUMENTS

| | | | | |
|---|---|---|---|---|
| 3,508,514 A | | 4/1970 | Vienna | |
| 3,633,532 A | | 1/1972 | Bruce | |
| 3,735,722 A | | 5/1973 | Hooper et al. | |
| 3,815,540 A | * | 6/1974 | Peereboom | 114/247 |
| 4,013,032 A | | 3/1977 | Bludworth | |

FOREIGN PATENT DOCUMENTS

| | | |
|---|---|---|
| GB | 2 108 436 | 5/1993 |

OTHER PUBLICATIONS

Takase Sotoo, "Method of ConstructionG Pusher Verge", Dec. 22, 1978.

* cited by examiner

*Primary Examiner*—Jesus D. Sotelo
(74) *Attorney, Agent, or Firm*—Wenderoth, Lind & Ponack, L.L.P.

(57) ABSTRACT

A floating multi-unit structure to be used for various operations offshore, on lakes, rivers, etc. It comprises two types of main units, termed propulsion/support unit and operative unit, respectively. Each such main unit includes at least one functional member. The two main units are adapted to be interconnected through their functional members and functionally integrated in a manner resulting in synergetic effects of the totality of the interconnected units. The propulsion/support unit includes one or more vessels equipped with propulsion machinery and equipment to meet support functions. When the propulsion/support main unit is comprised of several vessels, the individual vessels are functionally integrated in a manner resulting in a synergetic effect providing the propulsion/support main unit with the intended combined properties. The operative main unit includes one or more barge members equipped to perform the intended operations. When the operative main unit comprises several barges, the individual barge members are functionally integrated in a manner resulting in a synergetic effect providing the operative main unit with the intended combined properties.

11 Claims, 12 Drawing Sheets

FLOATING STRUCTURE

BACKGROUND OF THE INVENTION

1. Field of the Invention

The present invention relates to a floating multi-unit structure for performing various operations offshore, on lakes, rivers, etc., comprising an operative unit and a support unit releasably pivotably connectable to said operative unit.

2. Description of the Related Art

An example of a floating multi-unit structure of the above type can be found in GB-A-2 108 43 6, where the operative unit and support unit respectively consist of a barge equipped with means necessary to perform the intended operation and a pusher boat or vessel equipped with propulsive means for the interconnected units.

SUMMARY OF THE INVENTION

A main object of the present invention is to provide a system consisting of co-operating floating units configured in a manner to permit simple, rapid and economical displacement and/or operation of one or more operative vessels, at maximum personnel safety, while being highly flexible, i.e. suitable for use in a wide range of operational activities.

According to the present application such object is achieved with a floating multi-unit structure of the introductorily mentioned type, in which the support unit, apart from being equipped with propulsion means for the interconnected multi-unit structure, is also equipped with means (at least one unit) to synergetically support the operative unit in performing the intended operation.

Thus, according to the invention, the operative unit is a basic unit generally common to all of the intended operations to be performed, since it is adapted to be equipped with standardized operational equipment for a particular operation, such as offshore drilling and/or production and/or processing hydrocarbons, pipe laying operations etc, while the propulsion/support vessels are substantially of the same standard construction and configuration adapted for various operations to be performed by the main operative unit.

The term "basic unit", as used herein, should not be interpreted to mean that it merely refers to one single basic configuration. It lies within the scope of the invention to use a plurality of basic units of different configurations. Also contemplated are propulsion/support vessels of somewhat different configurations and sizes. The important aspect of the invention is the fact that by means of a limited number of prefabricated units it will be possible to build up vessels that can do a wide range ofjobs under widely different operational conditions.

The structure or system of the invention is configured in a manner to permit connection between its various members at an offshore location, at wave heights up to 3 meters while permitting disconnection also at larger wave heights and under all kind of weather.

The operative unit would normally be configured as a barge having a small number of standard configurations adapted to different operations.

Thus, the system according to the invention is built up around the combination of propulsion/support vessels and operative barges carrying equipment adapted to the particular operations. The propulsion/support vessels serve purposes beyond that of transporting a barge to the site of operation. Thus, apart from propulsion machinery the vessels are to be equipped so as to assist in the work done by the barge. The vessel-barge connecting portions are standardized in such a manner that the propulsion/support vessels are capable of being flexibly adapted to different needs and jobs.

For instance, it is contemplated that propulsion/support vessels are combined with a barge provided with drilling equipment, resulting in a drilling ship that can lie on DP (dynamic positioning). If a pipe laying vessel provided with DP is desirable, then the propulsion/support vessels are combined with a pipe laying barge. If instead, there is a need for a buoy-anchored production ship, then it might suffice to combine a production barge with one propulsion/support vessel. In those cases where the barge is anchored, it is contemplated that the propulsion/support vessel is disconnected from the barge from time to time in order to perform various operations that otherwise would have to be performed by other vessels.

By configuringamodular drilling-pipelayingunit (or alternatively aproduction unit) as described above, the highest DP class can be achieved with support vessels each having a lower DP class. The highest DP class is normally required, for instance, in connection with sensitive operations such as drilling and production.

The system uses a small number of standardized sizes for the propulsion/support vessels. The connecting equipment is standardized for all of the propulsion/support vessels and barges within each size category in question, in a manner to provide complete connection comparability.

The interconnection between the various members of the main units of the floating structure or system of the invention is carried out by means of a locking device permitting the vessels to have different draughts and further permitting them to move vertically relative to each other, resulting in reduced transfer forces. The locking device, therefore, is important in order to have the system work. It should be strongly pointed out, however, that the locking device is not the central aspect of the system, rather, it is the versatile use of propulsion/support vessels combined with operatively adapted barges that is the essential part of the invention.

Thus, when the system according to the invention is to be used in connection with the production of hydrocarbons offshore, the living quarter module, among other things, could be localized onboard a propulsion/support vessel which is positioned in a manner to be protected from possible fire, gas outburst, etc. on the main unit, i.e. the barge, carrying the production/drilling equipment. For the drilling variant there would be no need for disconnection, the purpose being that the same propulsion/support vessel could be used for production—as well as for the drilling unit. The system is also contemplated to be established for offshore structures for pipe laying, etc.

In connection with the production of hydrocarbons, for example, the propulsion/support vessel would be prepared for quick disconnection from the barge in case it would have to be evacuated. In some regions of the world that are particularly exposed to extreme environmental strains (e.g. typhoons), governmental security regulations require evacuation of personnel onboard production sites during periods when the personnel are apt to be exposed to typhoons. This is the case in the Gulf of Mexico and in Chinese waters, among other places.

The system according to the invention implies that such evacuation could be accomplished quickly and efficiently, by disconnecting the propulsion/support vessel from the barge and moving it to a safe area of the ocean. Compared to evacuation by helicopter, a such alternative evacuation of personnel would involve considerable advantages such as the shortest possible shutdown, a high degree of safety of personnel, no need for helicopter transport, etc.

Since the propulsion/support vessel is positioned in a protected area relative to the production/drilling site and capable of being very rapidly disconnected from the barge, the various governmental authorities would tend to be sympathetic as to accepting building the propulsion/support vessel in accordance with marine rules and regulations, which would also mean considerable additional economical advantages. The designation "propulsion/support vessel" as used herein, is a general term applicable to any vessel reflecting the multipurpose aspect of the system according to the invention.

The modular approach according the invention implies additional advantages enhancing flexibility or versatility in a very positive manner and reducing the total cost level. The following, among other things, can be mentioned:

The propulsion/support vessel can perform additional finctions at the field, such as preparedness, fire prevention, oil skimming, assistance related to the mooring of tankers loading oil, ROV operations, etc. When used in the Gulf of Mexico, the propulsion/support vessel could take care of transport of personnel to and from the field. Such additional functions, as a general rule, is contemplated to last for a relatively short period of time, such that the living quarter function could be maintained.

In some regions of the world there is limited access to docking capacity for large ships. By using the modular system according to the invention, barge hull dimensions could more easily be selected to fit within local limitations. This property would also permit the vessels of the floating structure according to the invention to be moved into regions with limited physical accessibility, such as via the rivers into the Caspian Sea. This means higher flexibility in connection with the building and equipment of the barge, and would also be an advantage in connection with future maintenance operations, etc.

The connection portion between barge and propulsion/support vessel would also be standardized, resulting in flexibility with regard to alternating vessels, etc. This property also opens a possibility of vessel co-operation between several field operators operating the same type of units primarily within the same geographical region.

The crux of the invention is the possibility of interconnecting vessel units having widely different purposes/properties which, through a synergetic effect results in accomplishments beyond the mere additive effect of the properties of the individual vessels. Depending on what types of vessels are combined, the totality of the vessel-properties can be changed.

The main units and their properties that when combined will provide such synergy effect would be:

Barge units equipped for operations such as drilling, production of hydrocarbons, pipe laying, single-point buoy mooring loading, storing of hydrocarbons;

barge units having mooring equipment and interconnected depending on the intended operations;

barge units adapted to receive self-floating system modules for assembling desired equipment;

system modules to be received in the barge unit;

vessels having propulsion machinery for connection to a barge unit or interconnection of barge units;

a high DP class can be imparted to a barge unit or barge unit assembly by interconnecting several propulsion/support vessels, that individually have lower DP class than the one desired in the particular case;

the propulsion/support vessels that are interconnected to barge units are equipped for auxiliary functions and personnel accommodation;

modularized stern parts and bow parts to be connected according to needs;

interconnection in the open sea as opposed to in a harbor as is the usual way of interconnecting;

interconnection of vessels having widely different properties of use;

transverse dock for receiving system modules;

possibility of interconnecting vessels and accommodating self-floating system modules providing flexibility as to water depth, smaller vessels; and modules having low draught can be transported/floated through shallow waters and then interconnected to perform operations in such waters (such as rivers in Russia and shallow parts of the Caspian Sea), while vessel combinations can naturally also be adapted for use in deep waters.

BRIEF DESCRIPTION OF THE DRAWINGS

The invention will now be described in detail, with reference to the highly schematic drawings, wherein.

DETAILED DESCRIPTION OF THE INVENTION

Like or similar parts are given the same reference signs throughout the Figures.

Figure 1:
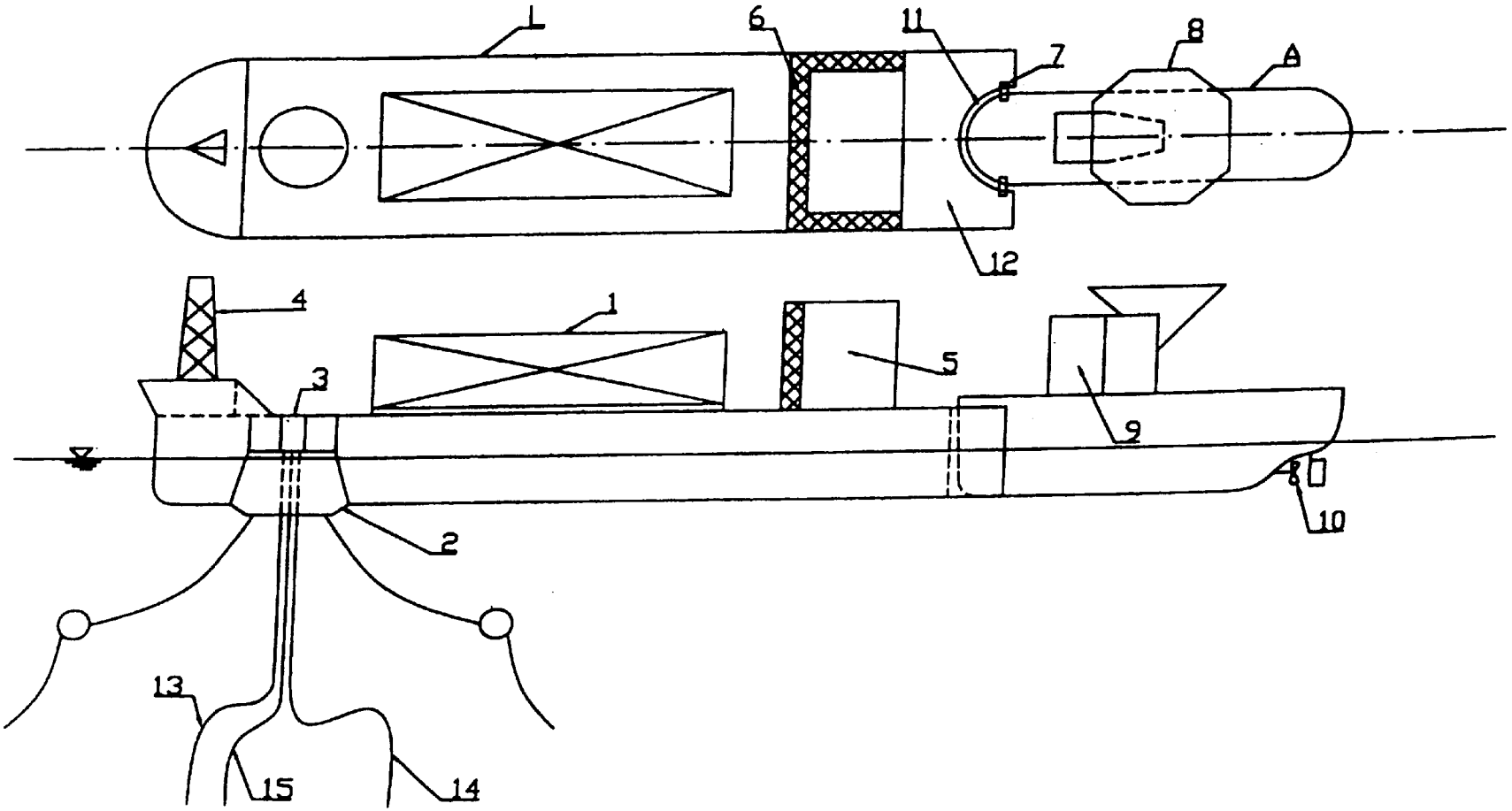
FIGS. 1–6 illustrate the floating structure according to the invention utilized in various operational situations.

FIG. 1 is a plan view and elevational view depicting a production barge L, assisted by a propulsion/support vessel or boat A, exporting oil/gas via a pipeline. In the Figure, numeral 1 denotes a process plant, 2 denotes a STP-buoy (could also be different turret version), 3 is a swivel permitting rotation of the unit, 4 is a flame tower, 5 is a control center possibly provided with a temporary cabin facility, 6 is a fire wall, 7 is a rapidly releasable connecting device, 8 is a helicopter deck, 9 is a living quarter module, 10 is an auxiliary propulsion plant, 11 is a standardized connecting portion between the barge L and the propulsion/support vessel A, 12 is an evacuating area, 13 is a production riser, and 14, 15 are transport pipelines for oil/condensate and gas, respectively.

As appearing from the drawing, the process plant 1, i.e. all necessary equipment for producing and processing a petroleum deposit from one or more wells at the ocean bed, is normally located at the barge L, while all equipment for operating the process plant (operating unit) is situated at the propulsion/support vessel A, together with the living quarter module 9, helicopter deck 8, and propulsion means 10. In particular cases, however, such equipment could be located at the propulsion/support vessel A.

In case of an emergency, when the production barge L would have to be evacuated, all personnel is evacuated via evacuating area 12 to the propulsion/support vessel A once the latter is released from the barge, by releasing the connection device 7 permitting the propulsion/support vessel to be rapidly removed from the barge L. If the emergency is caused by fire in the process plant 1, then the fire wall 6 in front of the evacuation area 12 assists in protecting the personnel during evacuation and disconnection of the propulsion/support vessel A.

The connection portion 11 advantageously could have the form of a concave profile 16 in barge L, adapted to receive a correspondingly convex profile 17 of the propulsion/support vessel A, normally of its bow and/or stern.

Figure 5:
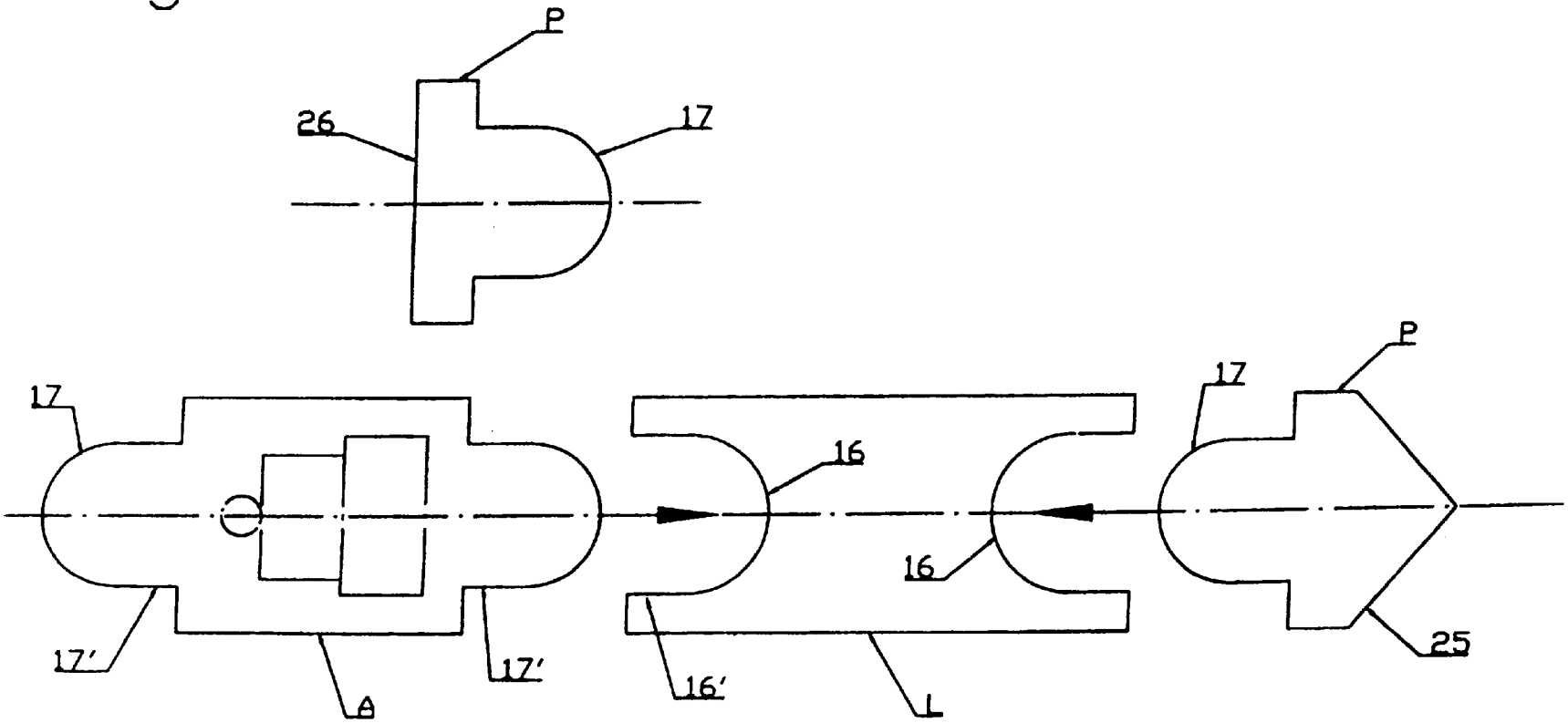

In the examples shown in the Figures, the bow portion of the propulsion/support vessel A forms a substantially convex, generally U-shaped connection profile 17 mating with a correspondingly concave generally U-shaped connection profile 16 in the aft end of barge L. The concave profile 16 and convex profile 17 of the connection portion 11 need not necessarily be U-shaped, they could be rectangular, for example, or have any other suitable configuration. In any case, however, the open entrance portion of concave profile 16 should have substantially straight parallel side walls 16' as shown in FIG. 5, with corresponding, straight parallel side walls 17' at the inner end portion of convex profile 17. The connection device 7 includes locking bolts 7' acting as a pivot joint between the two hull parts of the vessels A–L, permitting them to pivot relative to each other in a vertical plane when exposed to wave and wind forces.

Use of the system according to the invention as described above in connection with FIG. 1, would be particularly advantageous in areas having accessible pipeline-infrastructure and where the local authorities are restrictive with respect to export by shuttle tankers (e.g. the Gulf of Mexico).

Figures 2, 2A, 2B:
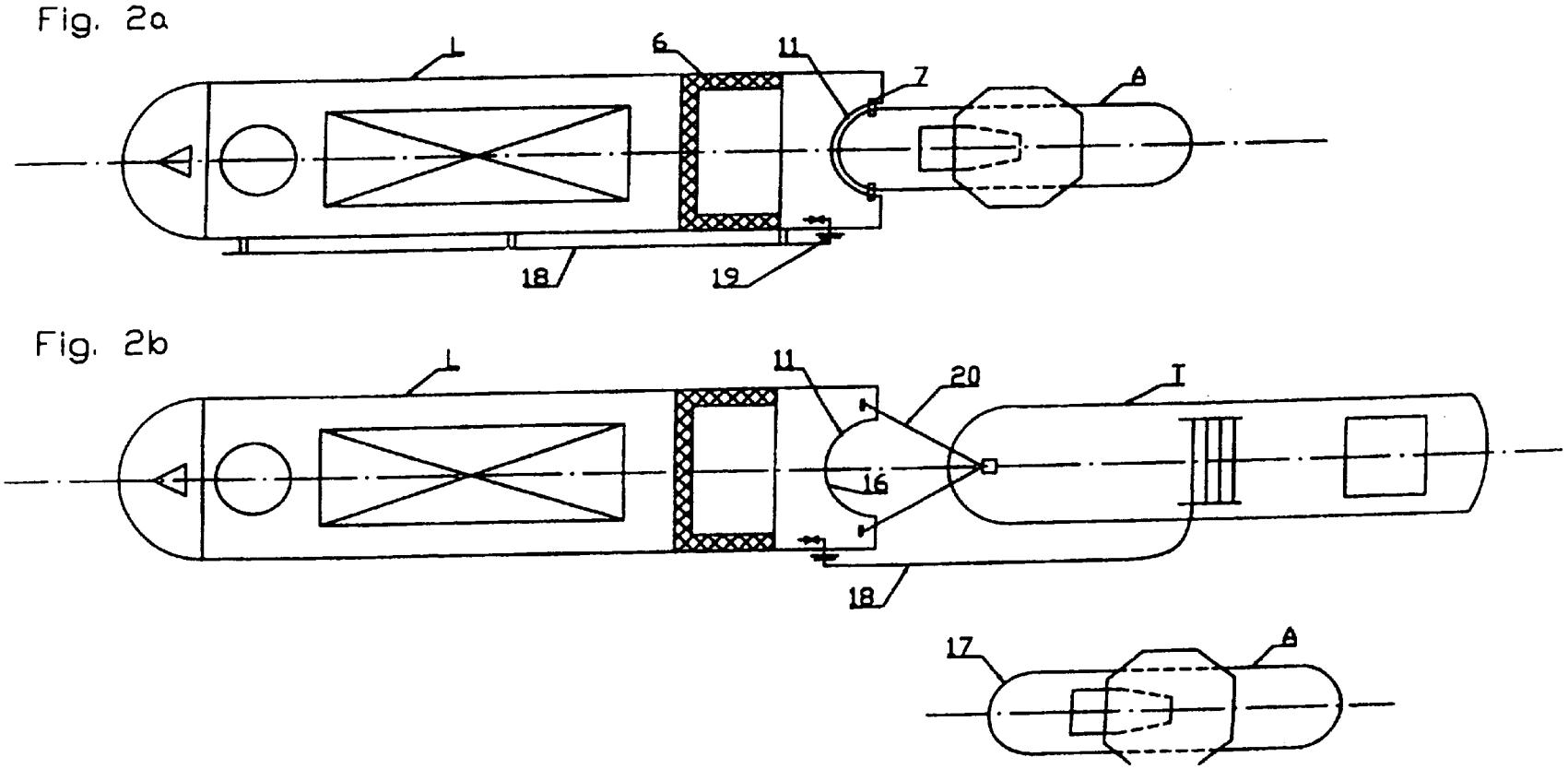

FIGS. 2*a* and 2*b* show an application of the system according to the invention intended for export by tankers. FIG. 2*a* is generally similar to the plan view of FIG. 1, except that the barge L is shown having a floatable hose 18 supported in position along the side of the barge, with a swivel 19 at the end closest to propulsion/support vessel A.

In the plan view of FIG. 2*b*, the propulsion/support vessel A is shown removed from barge L, in a waiting position spaced from the latter, while a tanker T is moored to the aft end of the barge by means of mooring hawsers 20 and with the floatable hose 18 in operative connected position. A typical loading operation would last 1–2 days. In this period the propulsion/support vessel A provides the necessary assistance to tanker T, such as when connecting and disconnecting mooring hawser(s) and the floatable hose 18 which normally is positioned along the barge as described above. The storing volume of the barge L can vary according to needs at the field.

Figure 3:
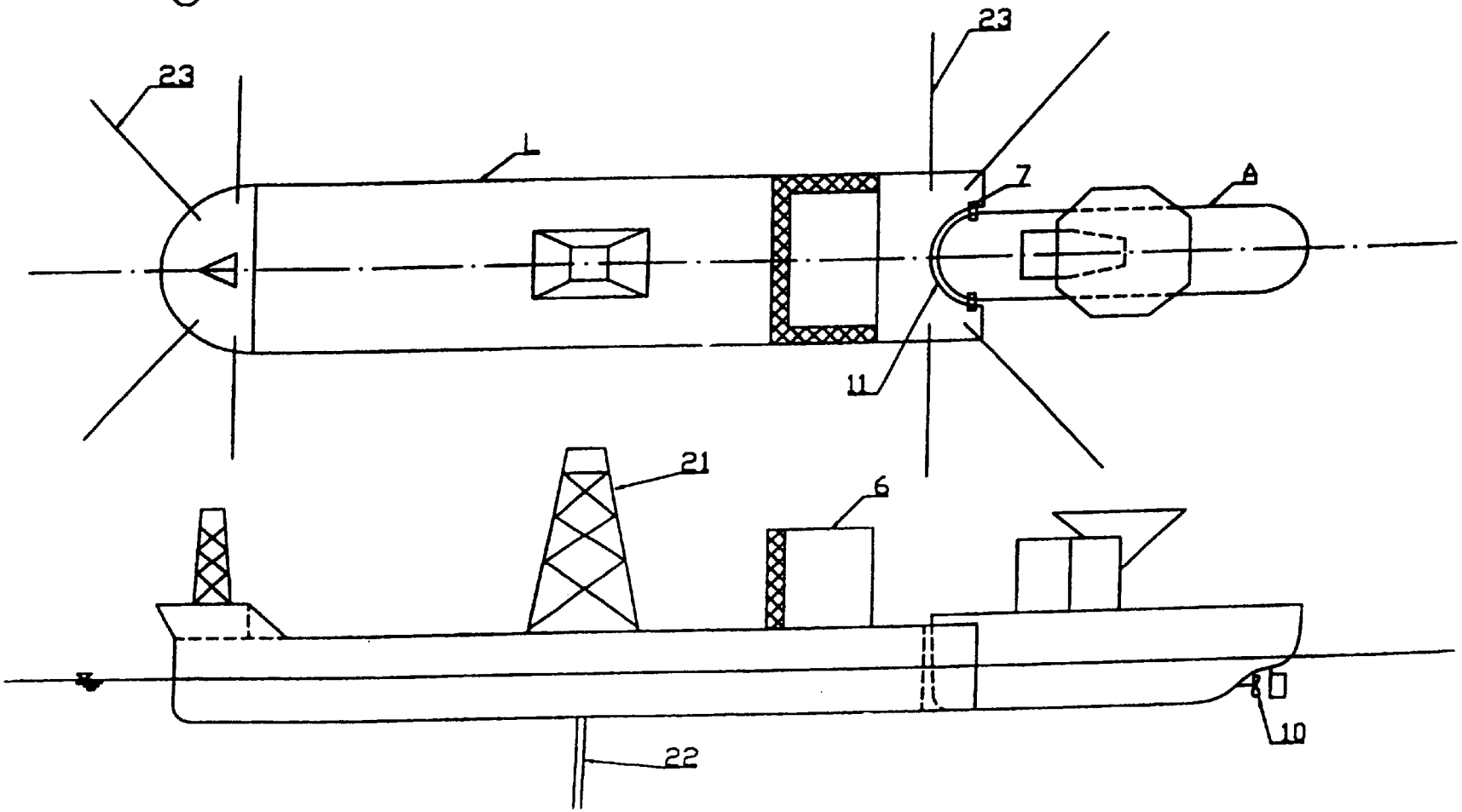
Figure 4:
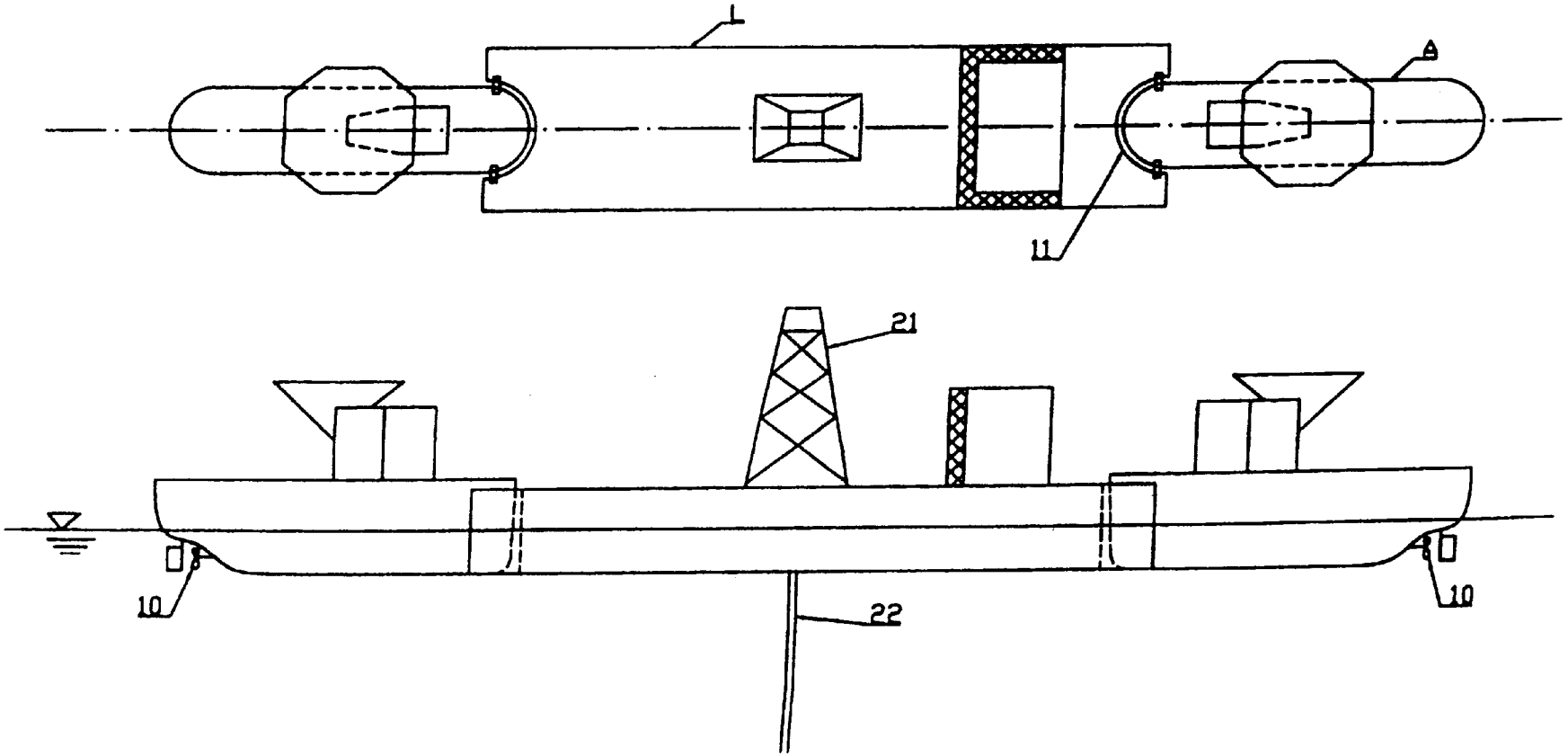

FIG. 3 illustrates the system according to the invention adapted to drilling operations. Instead of the production and processing equipment 1 at the production barge L according to FIG. 1, the drilling barge L shown in FIG. 4 is provided with a derrick 21 and other necessary drilling equipment including a drilling riser 22. Otherwise the system is substantially similar to that of FIG. 1. However, drilling barge L shown in FIG. 3 is provided with anchoring means 23, preferably in the form of a so-called "spread mooring". This applies only in areas of calm weather. However, other anchoring approaches, including turret anchoring, could be used.

In the situation in question, the propulsion/support vessel A would serve as a living quarter module. It is also contemplated that the drilling barge L is supplied with electric power by the propulsion/support vessel A during drilling operations.

Also in this embodiment of the structure according to the invention, propulsion/support vessel A is capable of being disconnected for performing other necessary field operations. Among other things, anchor manipulation could take place by means of the propulsion/support vessel A.

Preparedness functions, fire fighting, oil recovery, etc, are also operations that naturally belong to the operations defined for the propulsion/support vessel A.

FIG. 4 illustrates a modular 3-vessel floating structure building on the same principles as the above described systems or floating structures according to FIGS. 1–3. At each end of barge L there is connected propulsion/support vessel A provided with equipment for dynamic positioning (DP) (dynamic positioning unit). Power distribution is co-ordinated in a manner to satisfy DP requirements for drilling ships.

Living quarter modules are arranged onboard the respective propulsion/support vessels A, A, i.e. each propulsion/support vessel typically covers 50% of the demand. Other approaches are also possible.

The specific novel aspect of the system or floating structure according to FIG. 4, is that the main units, consisting of barge L and the two propulsion/support vessels A can be selectively disconnected and separately used for other purposes, if the situation so demands.

Since the three units are disconnectable, it would also be possible to bring them to areas where otherwise accessibility is a problem. Because in this case barge L is formed with a bow in each end, DP-operations might require rotation up to 90°. This reduces the demand for DP power. Alternatively, the system could be provided with a support anchoring of the drilling barge. The units would then operate in so-called DP assisted mooring mode. A typical region of operation for the modular DP drilling ship or barge L would be the Caspian Sea, for example.

The drilling barge L could be formed as a conventional barge provided with moon-pool. However, in order to ascertain facourable movements, the barge could also be provided with pontoons and columns as a rig structure.

Thus, three ship approaches could be configured for DP operated production vessels, pipe laying vessels, etc. By using two propulsion/support vessels, it would be possible to configure the entire drilling unit to the highest DP class.

As mentioned before, the propulsion/support vessels A are capable of being connected with their bow as well as their aft end against a barge unit. Thus, barges and propulsion/support vessels could be interconnected like "pearls on a string" such that a propulsion/support vessel is connected to one barge by its bow end, and connected to another barge by its aft end. If a barge has several concave portions for connecting propulsion/support vessels, and there is no need for using more than one propulsion/support vessel, then the unused concave portions of barge 12 could be occupied by a "plug member" or element, as indicated in FIG. 5. For example, by use of plug member P, one end of the barge could be given a bow shape 25, or stern shape 26, as shown in the Figure.

Figure 6:
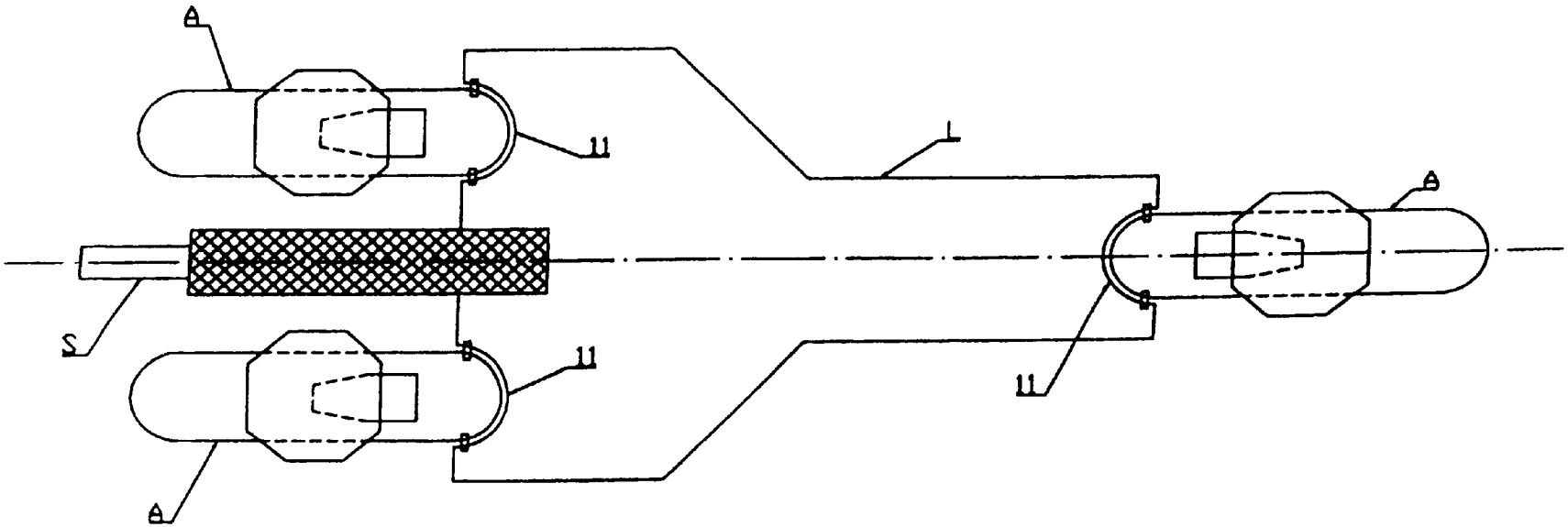

Of course, the barge(s) and propulsion/support vessel(s) used do not necessarily need to be aligned. Thus, a configuration could be contemplated in which a barge is formed with connection capacities for one propulsion/support vessel in one end and formed with two connection capacities for two propulsion/support vessels in the other end. Such an arrangement could be advantageous, for example, when building up a pipe laying vessel, such as indicated in FIG. 6. Here barge L is configured to be assisted by three propulsion/support vessels A, for example, one centrally located in the bow part of the barge and one at either side of the centrally located pipe stinger S in the end portion of the barge. Alternatively, the forward propulsion/support vessel could be replaced by a plug member P having a bow profile as described above in connection with FIG. 5.

An operative or barge unit of semi-submersible type, such as having two parallel hulls, could also be used.

An example of an embodiment of a releasable connection device 7 incorporated in the system according to the invention is described below in connection with FIGS. 7–9.

Figure 7:
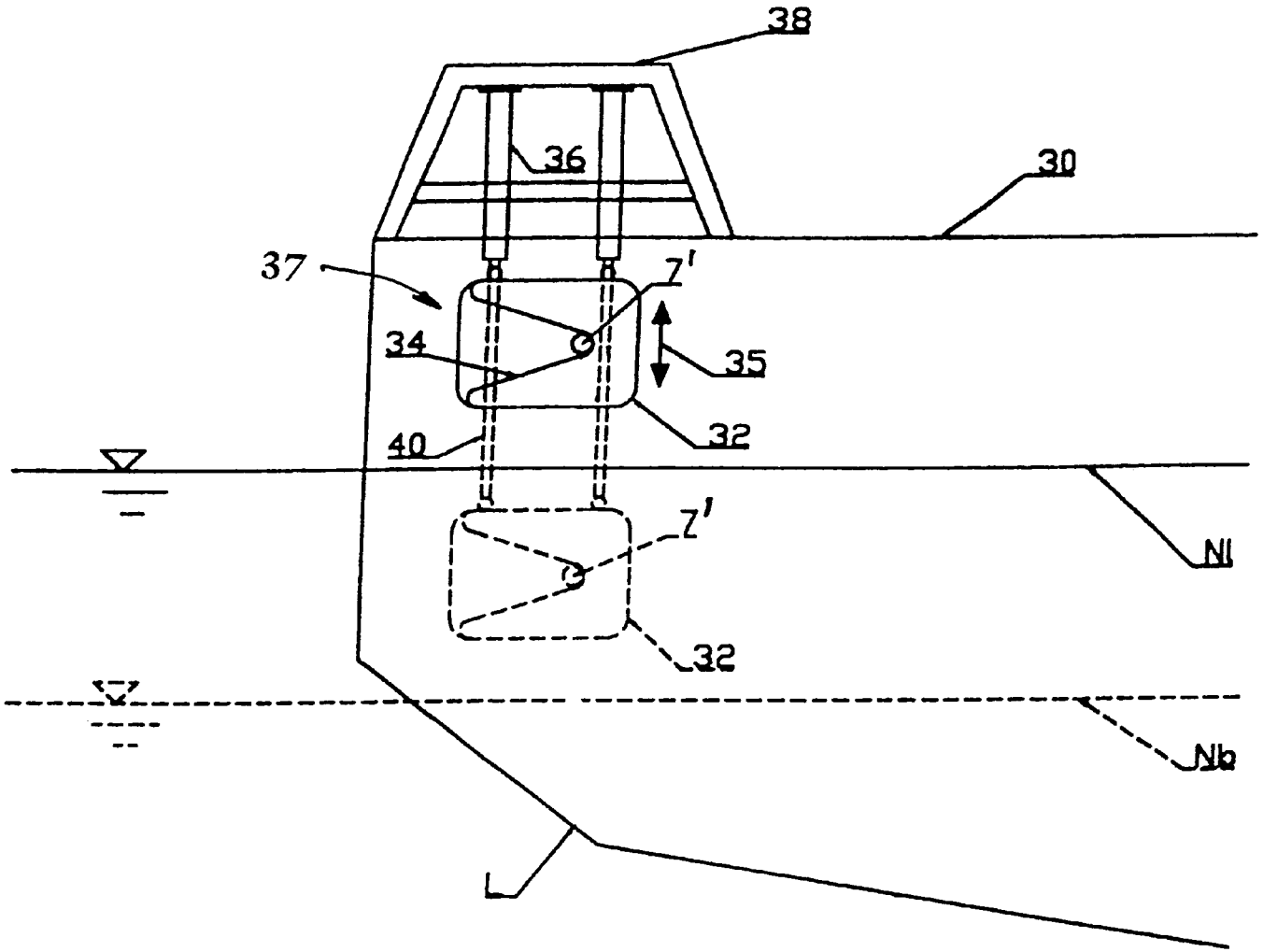
FIGS. 7–9 illustrate a locking device for interconnecting two main units incorporated in the structure.

FIG. 7 is a schematical elevational sectional view through the concave connecting profile 17, e.g. in the stern of a barge L. The deck 30 of barge L is indicated for two different levels or draughts: a high level $N_b$ above water surface 31, where the barge is ballasted, and a low level $N_1$ where the barge is loaded.

Figure 8:
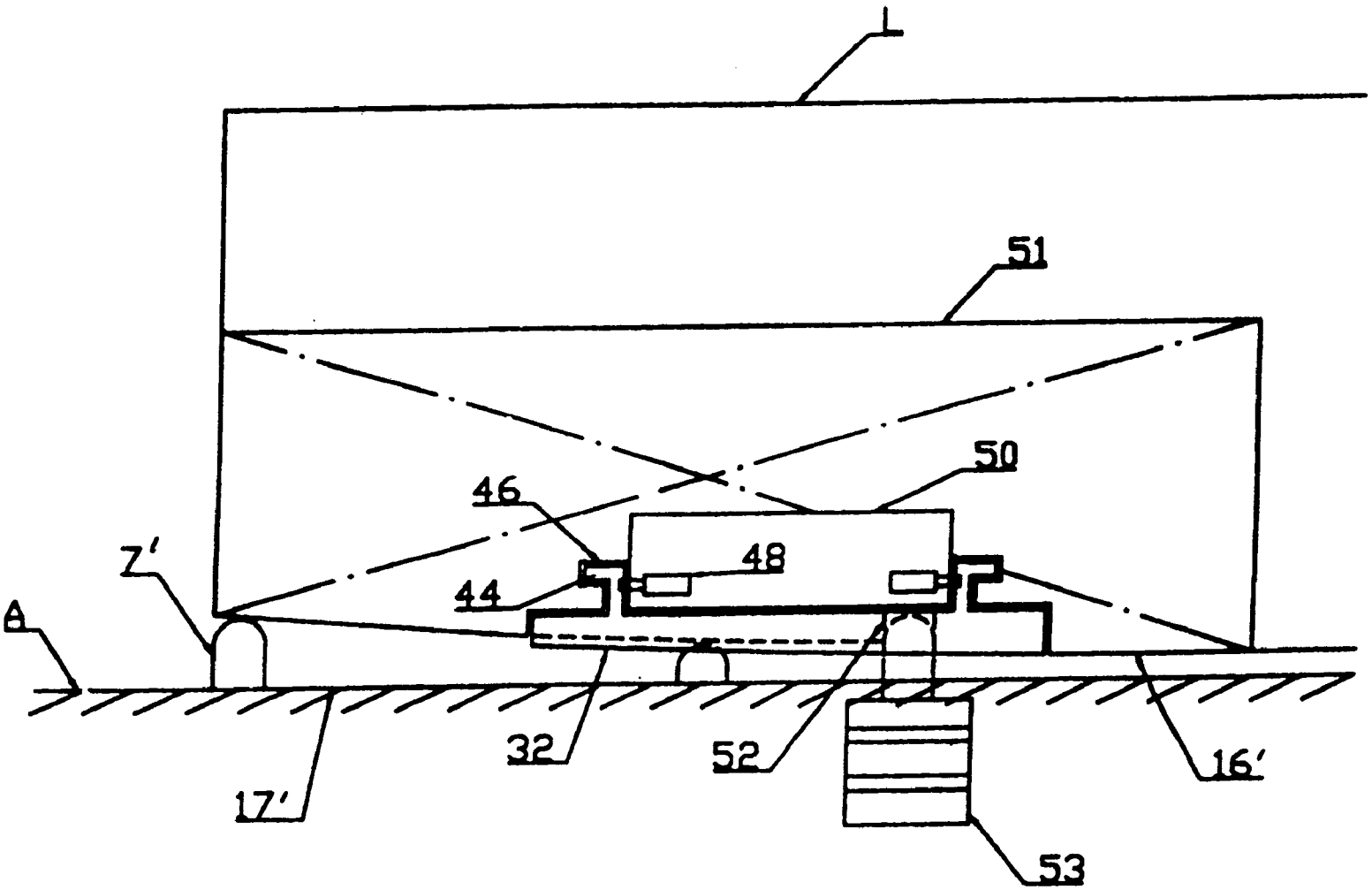
Figure 9:
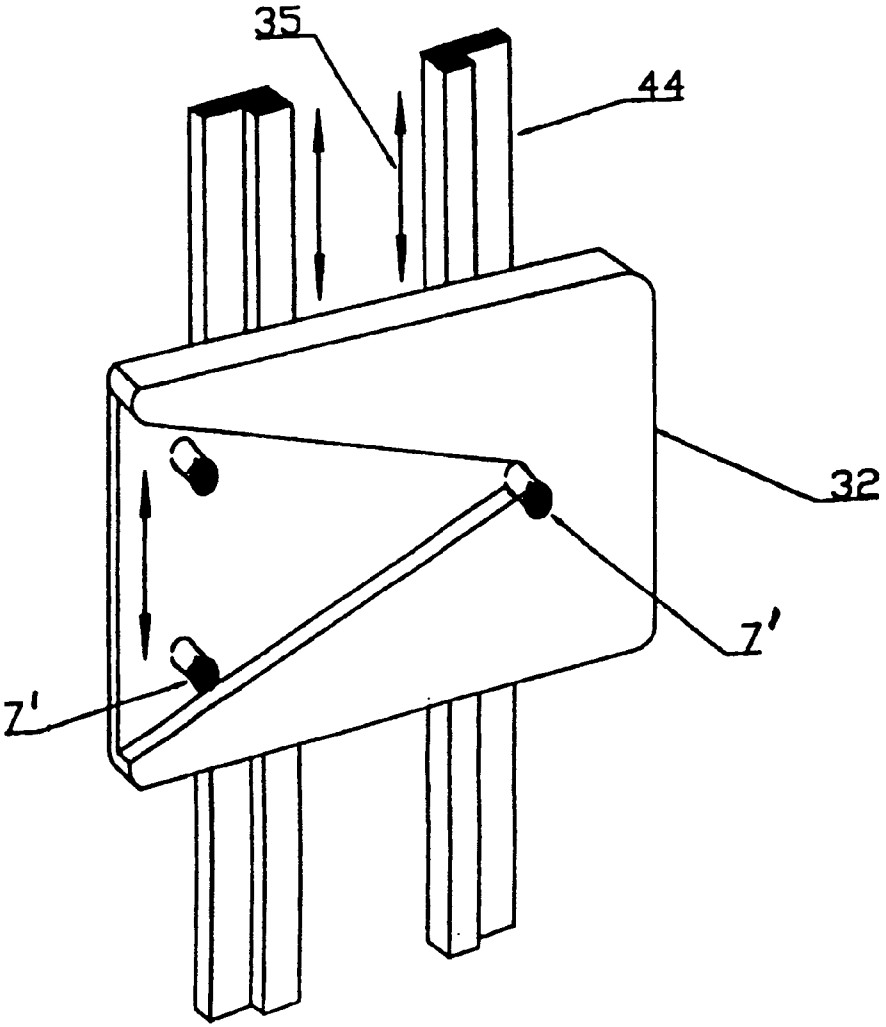

On each side wall 16' of the concave connecting profile 16 there is a plate like guide means 32 having a substantially V-shaped guide groove 34 for a locking bolt or stud 7' on either side of the corresponding convex connecting portion 17 of a propulsion/support vessel, as indicated in FIG. 8. Each guide plate 32 is adapted to be adjusted vertically upward and downward as indicated by arrows 35 in FIGS. 7 and 9, such as by means of two hydraulic cylinders 36 arranged in a frame structure 38 above deck level on barge L. The piston rods 40 of the cylinders 36, which may have a stroke of about 4, 5 meters, for instance, are connected to the top surface of the guide plate 32, while the rear surface of the guide plate is rigidly attached to two guide racks 44 which in their turn are slidably received in correspondingly formed guide grooves 46 at each side of the connecting profile entrance opening. The guide plate 32 is locked in a desired vertical position, such as by means of two pneumatic cylinders 48 preferably arranged in open spaces or cofferdams 50 which also provide access for replacement and maintenance of the equipment to be used. The system according to the invention may be used in connection with Arctic operations. In order to prevent freezing and ice accumulating in exposed areas such as around the guide racks 44, the guide means 32 could be surrounded by a tank 50 containing hot liquid in exposed regions.

The locking bolts 7', which have to co-operate with the guide plates 32 of the concave barge profiles 17, extend from opposite sides of the concave connecting profile 17 of the propulsion/support vessel, as indicated in FIG. 8, in which bolts 7' is shown in three successive positions during a connecting operation.

The connecting operation would generally take place in the following manner.

The pertaining convex connecting profile 17 of propulsion/support vessel A, that normally would be either its bow or stem, is maneuvered into the corresponding concave connecting profile 16 of barge L between its substantially parallel entrance side walls 17. Guide plates 32 have been pre-adjusted into desired vertical position relative to the draught of the vessel, by means of cylinders 36, i.e. such that the V-shaped guide groove 32 of the guide plate is positioned substantially at the level of the locking bolt 7' of the propulsion/support vessel, the opening dimension of the V-shaped locking groove being sufficiently wide to accommodate the locking bolt as indicated with an arrow 37, at wave heights up to about 3 meters. This situation is illustrated in FIG. 9 in which locking bolt 7' at the left hand side of the Figure is indicated in an upper and a lower position during the initial phase of the alignment operation, while at the right hand side of the Figure, it is shown in its final position at the bottom of alignment groove 32. When the locking bolt has reached its final position, it is pushed, such as by a pneumatic cylinder 53, into a corresponding hole 52 in guide plate 32, as shown in FIG. 8. The interconnection between the two vessels L, A will then be complete, and the propulsion/support vessel A is free to pivot about the locking bolts 7' in a vertical direction. This reduces forces transmitted between the interconnected vessels when exposed to wave motion.

When the interconnection is completed the vessels will be able to operate in combination without any weather limitations. Disconnection of the propulsion/support vessel can also take place regardless of the weather conditions.

From the disclosure described above, it will be clear that connection and disconnection between the modulized vessel units of the floating structure according to the invention can be performed in a fast and safe manner.

Although normally it would be preferable to have the main vessel or barge L formed with concave connecting profiles 16 while the propulsion/support vessels would be formed with convex connecting portions 17, such as described above and shown in the drawings, the connection portions 16, 17 could, of course, be arranged in a vice versa manner. Similarly, the locking bolts 7' could be provided in the main unit L part of the connecting portion 11 while the guide plate 32 would be situated in the propulsion/support vessel A part of connection portion 11, rather than vice versa as described and shown.

Figure 10A:
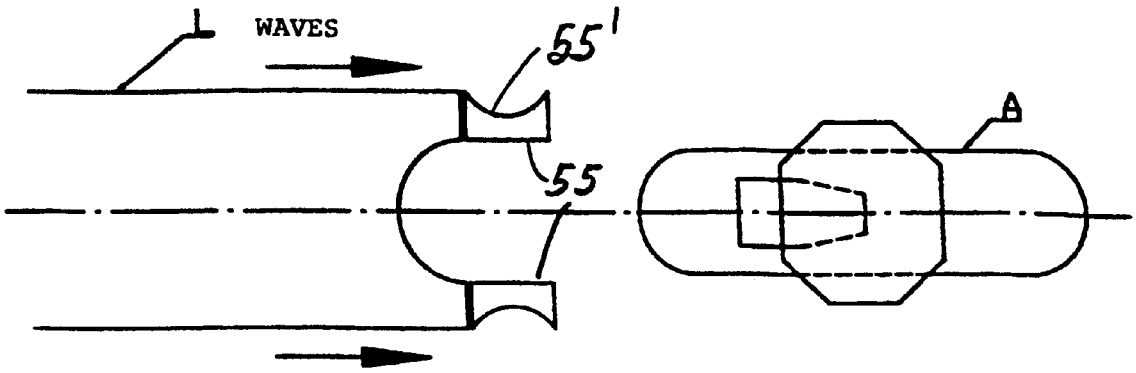
FIGS. 10*a*–10*c* illustrate an advantageous feature of the invention.
Figure 10B:
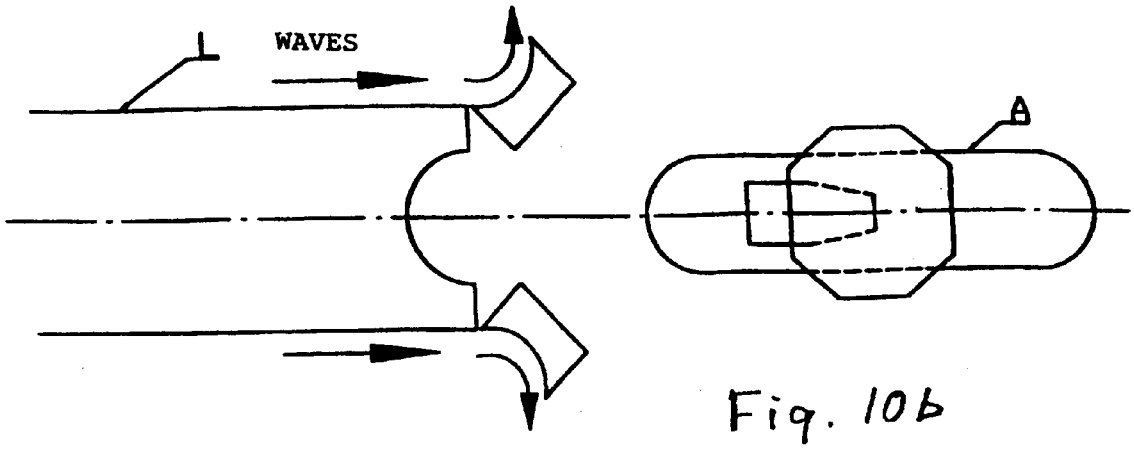
Figure 10C:
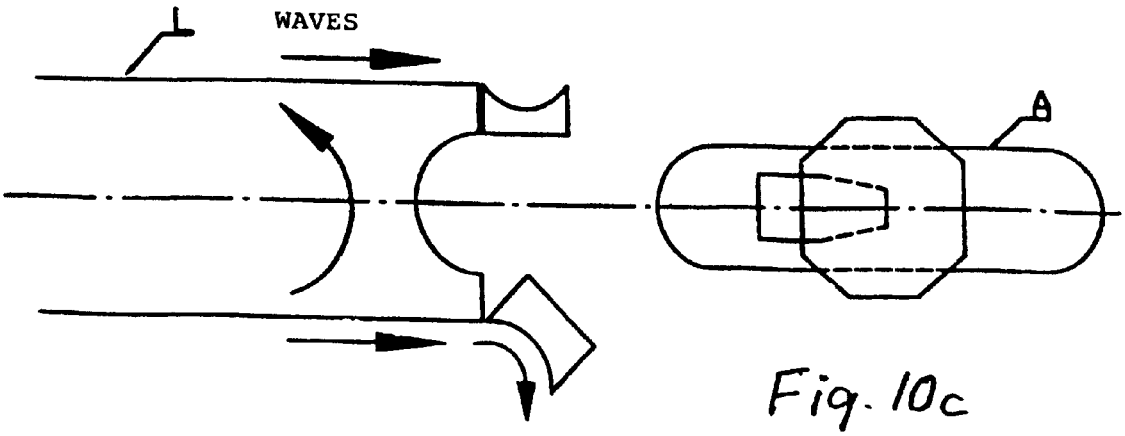

In those cases where a production barge is to be used, the stern part of the barge is advantageously provided with a form of twin rudders 55, as shown in FIGS. 10*a–c*. Such rudders, when in a "deployed" position, would provide an enhanced "mole" effect and calmer connection environments for the propulsion/support vessel. Further, the rudders could be used to turn the stern of the barge, such as in a connection situation. This is brought about by imparting to the rudder surfaces such a geometry (such as concave outer surface) that the water stream causes the barge to turn.

In FIG. 10*a*, both rudders 55 are shown in a neutral position. It should be noted that the outer rudder surface 551 could have a concave geometry ensuring favorable flow conditions with respect to the waves that normally travel in the longitudinal direction of the ship. The rudder surfaces would extend up to the barge deck level in the vertical, to achieve a large exposed surface.

In FIG. 10*b*, both rudders are shown in a deployed position, providing weather protection for the propulsion/support vessel.

In FIG. 10*c*, one of the rudders 55 is shown in a neutral position, while the other rudder is shown in a deployed position, causing the barge to turn.

Figure 11:
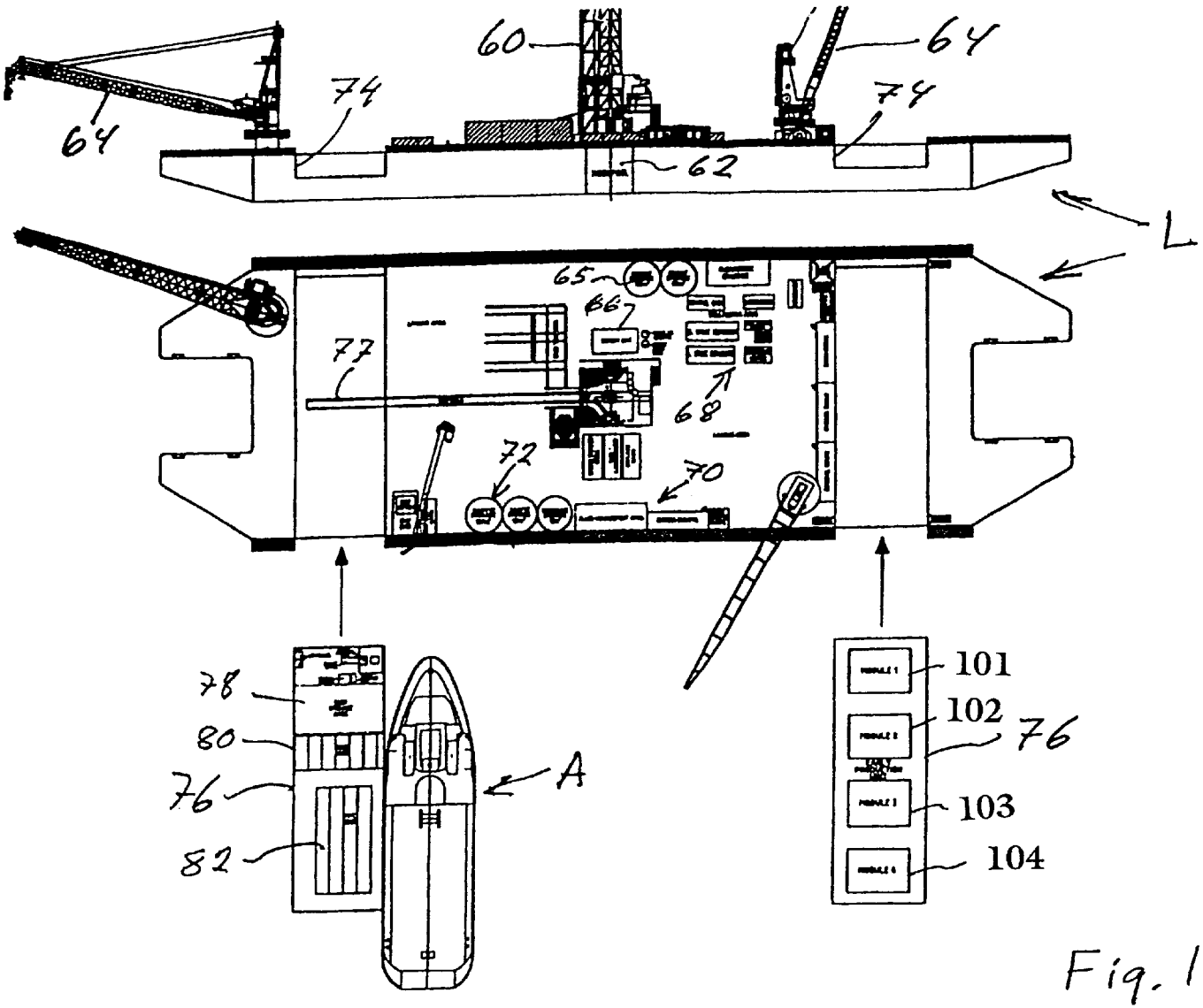
FIGS. 11 and 12 illustrate another embodiment of the structure according to the invention.
Figure 12:
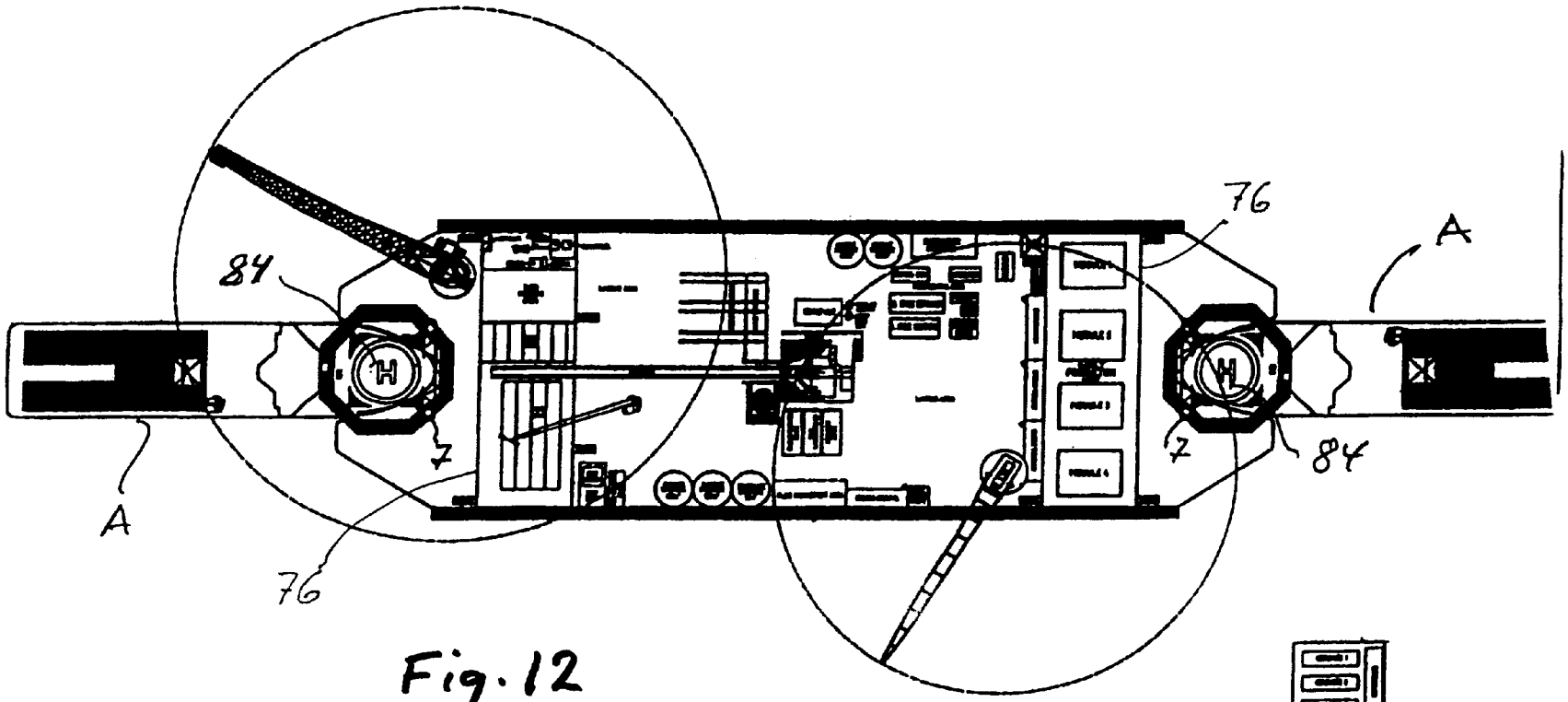

In FIGS. 11 and 12, a further example of a floating structure according to the present invention is shown.

As in the previous examples, the floating structure consists of one or more operative units L and propulsion/support units A. In FIG. 11, a main operative unit in the form of a barge L is shown in elevational and plan view combined with a co-operating propulsion/support unit A shown in plan view. Barge L is equipped for performing various, differing operations. Some of the equipment is permanently installed on the barge, such as a derrick 60 mounted above a moonpool 62, a hoist 64, a cementing production 65 and storing means 66, well testing means 68, subsea equipment 70, baryte storage 72, etc. The barge L is shown with a concave substantially rectangular connecting profile 16, adapted to matingly receive the concave bow connection profile 17 of an associated propulsion/support vessel A to be connected by connecting device 7.

As an important feature of this embodiment of the invention, the barge L is formed with one or more channel like recesses 74 formed in the deck of barge L, extending laterally of the longitudinal axis thereof and adapted to accommodate standardized equisized floating platforms or floats 76 carrying various additional equipment needed by the operative barge L to perform a particular operation. In the example shown in FIG. 11, the barge is shown with two such lateral recesses 74 together with their associated floats 76 ready to be floated into their respective recesses 74. The left-hand float 76 is shown provided with rack storage area 78, user rack 80 and pipe deck 82, while the right-hand float 76 carries a number of modules 101, 102, 103, 104 containing operative equipment such as early production equipment. A cat walk 77 extends centrally from midship across one of recesses 74.

FIG. 12 shows barge L with the floats 76 installed in place in their respective recesses 74 to complete the equipment necessary for the intended barge operation.

Figure 13:
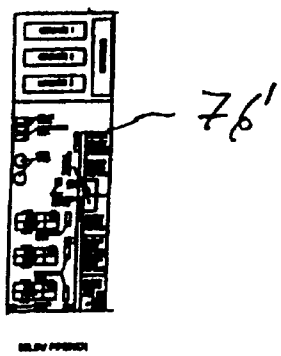
FIG. 13 illustrates a detail of the embodiment shown in FIGS. 11 and 12.

The floats 76 could have several "decks", arranged vertically below each other. For example, left hand float 76 of FIGS. 11 and 12 could be conceived as a "double-decker", having a second deck 76' below the pipe top deck, as depicted in FIG. 13, carrying additional operational equipment, such as generators, mud pumps etc.

Further, the barge L of FIG. 12 has connected to each end thereof, by connecting devices 7, two propulsion/support vessels A, e.g. for DP purposes, and is provided with helicopter decks 84.

The depths of the recesses 74 is sufficient to allow the floats 76 to be floated thereinto without having to ballast the barge to increase its draught. When the floats 76 are floated in place, the side opening(s) of the recesses 74 are closed by means of a gate (not shown) and the surrounding water pumped out of the recess.

The equipment carried by the floats 76 would normally be manufactured at a location remote from the barge L and propulsion/support vessel A, and then towed to and installed on the barge at an appropriate time.

What is claimed is:

1. A floating multi-unit structure for performing various operations offshore, said floating multi-unit structure comprising:

an operative unit comprising a plurality of vessels; and a support unit releasably, pivotably connectable to said operative unit, said support unit comprising a plurality of vessels, and said support unit having a propulsion plant and at least one unit operable to synergetically support said operative unit in preforming an intended operation, wherein individual vessels of said plurality of vessels of said operative unit and said support unit are functionally integrated in a manner resulting in a synergetic effect.

2. A floating multi-unit structure according to claim 1, wherein said plurality of vessels of said support unit are associated with at least one of said plurality of vessels of said operative unit, and wherein each of said plurality of vessels of said support unit has a dynamic positioning unit and said plurality of vessels of said support unit are controllingly interconnected in a manner to permit dynamic positioning of said operative unit and said support unit.

3. A floating multi-unit structure according to claim 1, wherein said operative unit and said support unit are operable to be used for producing oil/gas to be exported via a pipeline.

4. A floating multi-unit structure according to claim 3, further comprising twin rudders located at a stern portion of said operative unit.

5. A floating multi-unit structure according to claim 4, wherein each of said twin rudders has an outer rudder surface formed with a concave geometry.

6. A floating multi-unit structure according to claim 1, wherein said operative unit and said support unit are operable to be used for producing oil/gas to be exported by tankers.

7. A floating multi-unit structure according to claim 1, wherein said operative unit and said support unit are operable to be used in well drilling operations.

8. A floating multi-unit structure for performing various operations offshore, said floating multi-unit structure comprising:

an operative unit having a process plant; and a support unit comprising a vessel having an operating unit operable to operate said process plant, a propulsion plant, and a living quarters module and a helicopter deck to synergetically support said operative unit in preforming an intended operation, wherein said support unit is releasably, pivotably connectable to said operative unit.

9. A floating multi-unit structure for performing various operations offshore, said floating multi-unit structure comprising:

an operative unit comprising a barge having a connecting portion and a fire wall adjacent to said connecting portion; and a support unit having a propulsion plant and at least one unit operable to synergetically support said operative unit in preforming an intended operation, wherein said support unit is releasably, pivotably connectable to said operative unit.

10. A floating multi-unit structure for performing various operations offshore, said floating multi-unit structure comprising:

an operative unit; and a support unit having at least one plug member, a propulsion plant and at least one unit operable to synergetically support said operative unit in performing an intended operation, wherein said at least one plug member has a convex connecting profile at one end and one of a bow shape and a stern shape at an opposite end, and wherein said support unit is releasably, pivotably connectable to said operative unit.

11. A floating multi-unit structure for performing various operations offshore, said floating multi-unit structure comprising:

an operative unit having a stern portion, said operative unit having a stinger located at said stern portion, said stinger being operable to lay a pipeline, and said operative unit also having a concave connecting profile on either side of said stinger; and a support unit having a propulsion plant and at least one unit operable to synergetically support said operative unit in performing an intended operation, wherein said support unit is releasably, pivotably connectable to said operative unit.

* * * * *